US005903003A

United States Patent [19]

Schubert et al.

[11] Patent Number: 5,903,003

[45] Date of Patent: May 11, 1999

[54] METHODS OF COMPARATIVE ANALYSIS USING ION TRAP MASS SPECTROMETERS

[75] Inventors: Michael Schubert, Bremen, Germany; John Fjeldsted, Redwood City, Calif.; Jochen Franzen, Bremen, Germany

[73] Assignee: Bruker Daltonik GmbH, Bremen, Germany

[21] Appl. No.: 09/032,563

[22] Filed: Feb. 27, 1998

[30] Foreign Application Priority Data

Jun. 3, 1997 [DE] Germany ..... 197 09 172

[51] Int. Cl.[6] ..... H01J 49/42

[52] U.S. Cl. ..... 250/282; 250/292

[58] Field of Search ..... 250/282, 292

[56] References Cited

U.S. PATENT DOCUMENTS

| | | | |
|---|---|---|---|
| 5,107,109 | 4/1992 | Stafford, Jr. et al. | 250/282 |
| 5,448,061 | 9/1995 | Wells | 250/282 |
| 5,559,325 | 9/1996 | Franzen | 250/282 |

FOREIGN PATENT DOCUMENTS

| | | |
|---|---|---|
| 0630042 | 12/1994 | European Pat. Off. . |
| 2280781 | 2/1995 | United Kingdom . |
| 9518670 | 7/1995 | WIPO . |
| 9519041 | 7/1995 | WIPO . |

*Primary Examiner*—Kiet T. Nguyen

[57] ABSTRACT

The invention referres to analytic methods, the accuracy of which is increased by relating signals of analyte ions to those of reference ions, or by relating ion signals from measuring methods under special conditions to those of reference methods. If such "comparative" analysis procedures are performed in ion trap mass spectrometers, problems arise with the low dynamic measuring range covered by one spectrum in such mass spectrometers and, if different spectra are compared, with the control of the space charge within the ion trap. The invention consists in acquiring analyte spectra and reference spectra in different acquisition procedures, alternating between both types of spectrum acquisitions as fast as possible, whereby control of the space charge in the ion trap proceeds separately for the spectra of both types, the control being related to previously acquired spectra of the same type. A similar procedure can be set up, if measuring results of two different sets of measurement conditions have to be compared. The control variable for the space charge control is derived from the last respective individual spectra scanned under the same conditions. Due to this fast interchanging of individual spectra, time-saving control of the space charge is achieved on the one hand, and a large dynamic measurement range is available on the other.

10 Claims, 1 Drawing Sheet

$f_4$ $f_3$ $f_2$ $f_1$ $$a_3 = f_3 - f_4 \qquad a_2 = f_2 - f_3 \qquad a_1 = f_1 - f_2$$

$$b_2 = a_2 - a_3 \qquad b_1 = a_1 - a_2$$

$$c_1 = b_1 - b_2$$

$$f_{lin} = f_1 + a_1$$

$$f_{qu} = f_1 + a_1 + b_1$$

$$f_{cub} = f_1 + a_1 + b_1 + c_1$$

$f_1$ $f_2$ $a_1 = f_1 - f_2$ $f_3$ $a_2 = f_2 - f_3$ $b_1 = a_1 - a_2$ $f_4$ $a_3 = f_3 - f_4$ $b_2 = a_2 - a_3$ $c_1 = b_1 - b_2$ $f_{lin} = f_1 + a_1$ $f_{qu} = f_1 + a_1 + b_1$ $f_{cub} = f_1 + a_1 + b_1 + c_1$

*Figure 1*

METHODS OF COMPARATIVE ANALYSIS USING ION TRAP MASS SPECTROMETERS

The invention referres to analytic methods, the accuracy of which is increased by relating signals of analyte ions to those of reference ions, or by relating ion signals from measuring methods under special conditions to those of reference methods. If such "comparative" analysis procedures are performed in ion trap mass spectrometers, problems arise with the low dynamic measuring range covered by one spectrum in such mass spectrometers and, if different spectra are compared, with the control of the space charge within the ion trap.

The invention consists in acquiring analyte spectra and reference spectra in different acquisition procedures, alternating between both types of spectrum acquisitions as fast as possible, whereby control of the space charge in the ion trap proceeds separately for the spectra of both types, the control being related to previously acquired spectra of the same type. A similar procedure can be set up, if measuring results of two different sets of measurement conditions have to be compared. The control variable for the space charge control is derived from the last respective individual spectra scanned under the same conditions. Due to this fast interchanging of individual spectra, time-saving control of the space charge is achieved on the one hand, and a large dynamic measurement range is available on the other.

PRIOR ART

To increase analytical accuracy, comparative analyses are expedient whenever the processes of sample preparation, sample introduction or measurement cannot be kept completely constant. Comparison of an analytic measurement with results from a reference measurement attained as simultaneously as possible may serve as a control check of the measurement method. Especially, the comparison of the signal from an analyte substance to the signals of an "internal reference" substance admitted to the sample before sample preparation can compensate for losses of analyte substance during sample preparation. There are many designs of such comparative analyses. The method of quantitative, mass spectrometric analysis using an isotope-marked internal reference substance, the ions of which are measured in the same spectrum, is just one of these.

Paul ion traps consist of an RF-supplied ring electrode and two end cap electrodes; ions can be stored inside this structure. The ion traps may be used as a mass spectrometer by ejecting the stored ions mass-selectively through perforations in one of the end caps and measuring them outside using secondary-electron multipliers. Several different methods are known for such mass-selective ion ejection which will not be described here in detail.

If well resolved spectra with correct mass assignment are to be obtained, only relatively few ions can be stored in high performance ion trap spectrometers. If there are too many ions in the ion trap, the space charge of the ions disturbs ion ejection and consequently the scan. Thus, for a widely distributed, commercial mass spectrometer of this type, reports have told of only 300 utilizable ions available for the measurement of an individual spectrum. In ion traps used by the applicant company, approximately 2,000 ions are available for an individual spectrum. Even with this, however, the dynamic range for comparative analyses within a spectrum is extremely limited. The effect of space charge may even depend on the distribution of the ions on different mass-to-charge ratios.

The space charge limit may be determined from the drift of the ion signals or from the increase in width of the signal. A standard definition relates to a drift of 0.1 atomic mass units, meaning that as a space charge limit the exact ion quantity in the ion trap is defined which effects a delay in the ejection of ions by such a difference in time that, when converted to mass, corresponds to a mass drift of 0.1 atomic mass units from normal conditions.

Inception of the space charge effect is relatively clear-cut. An increase of only 10% in the filling quantity at the space charge limit already causes another drift by about 0.1 atomic mass units. If one remains only about 20% below the space charge limit, the mass drift is no longer measurable. It is well below 0.01 atomic mass units.

The optimal filling quantity must always remain a safe distance below the filling quantity at the space charge limit. This safe distance to be selected depends upon the quality of the space charge control. A very good control allows work at an optimal filling that is only 20% below the space charge limit. A control which is less good may necessitate work at half or even at one third of the space charge limit. Therefore, the quality of the control has a strong influence on the dynamic range of measurement in the spectrum.

Ion trap mass spectrometers have, on the other hand, properties which make their use attractive for many types of analyses. Thus selected ion species may be isolated and fragmented in the ion trap. The spectra of these fragment ions are known as "daughter ion spectra" of the relevant "parent ions". "Granddaughter ion spectra" may also be measured as fragment spectra of selected daughter ions. Through the addition of reactant gases, ion-molecule reactions may be studied, such as the dependence of their reaction velocities on the concentrations of the reaction partners. Or groups of substances may be analyzed by their formation of characteristic product ions with certain reaction gases, thus offering a type of „generic" analysis procedures for substances, the spectra of which are not even known.

For the above-named reasons, the necessary adjustment of the ion trap to changing concentrations of substances but also, for example, to changing ionization, reaction or decomposition conditions, comparative analyses may not be undertaken in the ion trap using the dynamic range of measurement of a mass spectrum under normal conditions, such as is possible for magnetic sector field or quadruple filter mass spectrometers. The latter have dynamic ranges of measurement from 6 to 9 orders of magnitude for the measurement of the ion currents of a spectrum.

In an ion trap, the maximum three orders of magnitude dynamic measuring range have to be adjusted thoroughly to cover and follow the changing concentrations of the substances. If, for example, the concentration of a substance in the sample is high, the ion trap is filled in a very short time with the optimal amount of ions. If on the other hand the concentration is very low, a long time is required in order to fill the ion trap optimally. This also applies in a similar manner to the filling of the ion trap with reaction products or daughter ions.

The filling times may, in practice, be varied between 10 microseconds and 1,000 milliseconds, i.e. over a range of 5 orders of magnitude. If this method is applied to quantitative analysis, the concentration is then calculated from a value which—at constant generation of ions—is calculated as the signal height in the spectrum divided by the filling time. This value is proportional to the average ion current of this ion species which is generated during ionization. In this way, by application of this calculated value for the ion current, the dynamic range for the determination of substance concentrations is comparable with that by other types of mass spectrometers. The dynamic measurement range for ion trap mass spectrometers thereby increases from meager 3 to satisfying 8 orders of magnitude. However, this only applies however if there is not a disturbing surplus of other ions in the ion trap. If there are two substances of very different concentrations to be measured in the same spectrum, performance of the task becomes impossible.

The control of the filling process of ion trap must be based upon a measurement of the ion number in the ion trap, from which a control value for the filling may be calculated. Since there is not a simple method for nondestructive counting of ions in the ion trap, two different methods for space charge control have been developed:

(1) The "prescan" method, for which a brief filling process with a constant filling time for the actual scan is placed upstream. The ions thus formed are expelled from the trap and measured. The optimal filling time is determined from this measurement value (U.S. Pat. No. 5,107,109). An improvement of this would be in not keeping the filling time of the prescan constant, but to instead control the filling time of the prescan from preceding measurements toward optimal measuring conditions (U.S. Pat. No. 5,448,061). Both of these methods require additional measuring time for the prescan which is lost for the actual scan.

(2) An improved method uses a filling control which is based on the known filling rate of one or even several preceding spectra (U.S. Pat. No. 5,559,325). From these filling rates of previous spectra, a forecast "expected value" is extrapolated for the current filling rate. The extrapolation may be linear, quadratic, cubic, exponential or based on any other known function, according to conditions. From the forecast expectation value, the current filling rate is calculated for the optimal filling quantity. The filling rate is defined here as the filling quantity divided by the known filling time, the filling quantity determined as an integrated ion current over the full spectrum. Since the previously measured analytical spectra are used here, no additional time for an prescan without any analytical purpose is wasted. This type of space charge control is a great improvement over the prescan method, especially if large changes in the concentration of the substances occur, such as exist for example when coupled with chromatographic separation methods.

The so-called "internal reference" method is well known in all designs of quantitative analysis. It consists of adding an exactly known amount of reference substance to an exactly known amount of analyte substance (preferably before any sample preparation) and comparing the unknown quantity or concentration of the analyte substance to the known quantity or concentration of the reference substance for final evaluation of analysis results. If the two substances are so similar to one another that they demonstrate the same behavior for all steps of sample preparation and analysis, all losses, changes or differences in sensitivity are made relative and eliminated through comparison with to one another.

In the following, the internal reference method is treated as an example of comparative analysis, although there are many different types of comparative analyses with different objectives.

In mass spectrometry, it is expedient to use isotopically altered reference substances which correspond exactly to the analysis substances chemically. For example, benzene (molecular weight 78 atomic mass units) may be excellently analyzed by adding fully deuterized benzene (molecular weight 86 atomic mass units) as a reference. Losses through evaporation, various ionization probabilities for substances and many other effects that corrupt analysis results are thereby eliminated to the greatest extent.

But also reference substances of another kind, chemically very similar to the analysis substances, may be used as reference substances, for example isomers, if they produce a different mass spectrum.

For the analysis of mixtures, the mixtures must normally be separated first using a separation method. Here, the well known chromatographic or electrophoretic methods are suitable. Usually, coeluting reference substances are then selected for the internal reference method in order to have conditions as similar as possible for quantitative determination. Isotopically marked substances usually have (almost) the same retention times.

In this way, many difficulties in quantitative analysis may be eliminated using coeluting substances. Thus for example, a secondary-electron multiplier, used as an ion detector, may be fatigued by preceding overloads with ions from the same chromatogram. In this way, sensitivity becomes time dependent, slowly increasing again through subsequent recovery effects. This temporally changing sensitivity may however be made relative again through coeluting analysis and reference substances and therefore taken into consideration.

For an ion peak consisting of 100 ions, even with a constant supply of substance, a fluctuation of results from repeated scans must become apparent which is characterized, based on ion statistics, by a relative standard deviation of 10%. Even for 1,000 ions, there is a fluctuation with a relative standard deviation of 3%. Only for 10,000 ions, the relative standard deviation is reduced to 1%.

Depending on the precision (repeatability) required for the analysis method, at least 100, 1,000 or even 10,000 ions must therefore be measured. It is thus apparent that, in an ion trap, increased precision can usually not be achieved by the ions of an individual spectrum, but instead several spectra must be considered. In ion trap work, several consecutive "individual spectra" are usually added together to produce a "sum spectrum", before the spectrum is evaluated.

The lack of dynamic measurement range which still prevails even in sum spectra, has an especially dramatic effect on the precision of measurements of relative concentrations in comparative analysis. If the reference and analyte substance are to be measured in one single overlapping spectrum, with ions located together in the ion trap, the concentrations must be exactly equal if optimal precision is to be achieved. First, the signals of the two substances can contain only half the optimum number of ions. This reduces precision by a factor of $\sqrt{2} \approx 1.4$. Furthermore, by the error propagation by division for the comparison, precision worsens by a another factor of $¢2 \approx 1.4$, reducing precision in total by a factor of 2. If the concentration of one of the two substances is reduced by a factor of 10, the precision of the analysis is reduced in total by more than a factor of 3.

In practice however, the concentration of the analyte substance in an unknown sample is not known before measurement. Therefore the simultaneous measurement of analyte and reference substance in an ion trap is practically impossible due to dramatic losses in precision, if not completely impossible because one of the substances becomes undetectable in the presence of the other when the other substance has an overwhelming concentration.

OBJECTIVE OF THE INVENTION

It is the objective of the invention to find a method for comparative measurement in an ion trap which functions with satisfactory precision even if the ions of the signals to be compared with one another are produced in an ionization, storage, isolation or fragmentation process with very different generation rates such as is the case, for example, in quantitative analyses using analyte and reference substances of differing concentrations.

DESCRIPTION OF THE INVENTION

The ions from signals to be compared with one another will be designated in the following as "analyte ions" and "reference ions" even if they are identical ion species, such as for example in the study of ion-molecule reactions when applying reference processes.

It is the basic idea of the invention to measure the analyte and reference ions alternately in separate spectra, and not in one spectrum, and to control the filling processes for each of the spectra optimally by expectation values for the filling rates derived from the last spectra of the same ion species. All other parameters of the measuring procedures for the two different types of spectra have to be kept as constant as possible. Therefore, two control strings are operating in parallel, one for the "analyte spectra" with the analyte ions and one for the "reference spectra". No time-consuming prescan is required for the control, although the spectrum directly preceding in time is not used for the control for obvious reasons.

If both substances in a sample are introduced to ionization at the same time, such as for quantitative analysis using a coeluting internal reference, they therefore also fill the ion trap together and lead to a mass spectrum containing both species of ions. It is therefore a further basic idea of the invention to isolate the ions of both substances in the ion trap and then measure them in separate spectra with the respectively optimally controlled filling. Isolation may already take place in a known manner during ionization using resonance ejection of undesirable ions by application of an exciting frequency mixture with gaps. On the other hand, as is also known, isolation methods may be applied after a controlled overfilling of the ion trap, since the isolation methods can still function even if the ion trap is overfilled by more than 100 times. In this way, even for subsequent isolation, the desired dynamic range of measurement is maintained in the spectrum. In both cases, the "spectrum" consists only of the isolated ions.

Even in the case of alternate isolation of analyte and reference ions, the filling must be controlled optimally. It is therefore a further idea of the invention to include the process of isolation in the filling rate and its determination from earlier spectra. The integration of the ion current via a spectrum of this kind already produces the filling quantity which was generated by ionization, storage and isolation. In U.S. Pat. No. 5,559,325, the filling rate relates only to the primary ion generation and storage, while here the definition of the filling rate is extended to include the reduction of the number of ions during the isolation process.

It is a further idea of the invention to refer to the daughter or granddaughter ion spectra of isolated parent ions after their fragmentation for quantitative analysis, and to also include the ion loss during the fragmentation process in the filling rate. Here too, it is only necessary to use the earlier daughter or granddaughter spectra of the same type for the control.—The particular advantage here is that these methods still function even when the parent ions are superimposed by other ions of the same mass-to-charge ratio, though of unknown concentration, as long as only the daughter ion spectra differ.

Here, the particular advantage of control through recourse to earlier scanned spectra becomes apparent For the prescan method, which must also include isolation and fragmentation of the ions for the prescan, the additionally required time becomes excessively great For comparative reaction analysis, which relates back to standard parameters for a reference reaction, such an isolation of the ions is not absolutely necessary. For a comparison of more than two ion species or more than two reaction conditions, three or more spectra may also be measured alternately, whereby three or more control strings must then run in parallel.

Since the measurements of the ion current integration values necessary over a spectrum for later control already took place two or more individual spectrum scanning times before, it is important to implement an extrapolation of the filling rate for the control such as suggested in U.S. Pat. No. 5,559,325. The forecast value for the expected filling rate, which determines the filling time, does not use just the filling rate measured in the last spectrum of the same type, but instead an extrapolation from two, three or even four of the last spectra of the same type, for example using a linear, quadratic or cubic extrapolation. For the start of chromatographic peaks (in the bottom area of the bell-shaped curve of the peak), an exponential extrapolation of only two spectra may also be performed with great success, which is simply based upon the "growth factor" of the exponentially increasing ion current signal from spectrum to spectrum.

Due to this fast interchanging of spectra with a separate filling control for the individual ion species to be compared, the dynamic range of the measurement is now increased quite significantly. For example, the concentrations of analyte ions and reference ions from a quantitative measurement may be separated from one another in both directions by up to a factor of 100 or more, without deteriorating the precision of the analysis. Therefore, a quantitative analysis with consistent precision over more than four orders of magnitude becomes possible, without changing the concentration of the reference substance.

Since an individual spectrum, as presented above, often does not correspond to the precision requirements of the analysis, several spectra often must be added together. Here the raw spectra must be added together before any further evaluation because only in this way does the signal-to-noise ratio increase accordingly. Usually, about 3 to 20 individual spectra are compiled into a "sum spectrum" by the addition of all corresponding individual measurement values along the scan. For obvious reasons, this addition must now also be done separately for the individual ion species.

For optimal control according to this invention, it is not practical here to scan the individual spectra one after another for a sum spectrum, since otherwise the optimal chain of control is interrupted for too long. More importantly, the individual spectra must expressly be scanned in alternate order to perform the filling control optimally. Here an addition of the individual spectra takes place simultaneously for two (or more) sum spectra.

It has been observed that the optimum filling of the ion trap with ions somewhat depends on the mass-to-charge distribution of the ions in the trap. Therefore, the filling amount may be obtained by a weighted integration over the ion current of the spectrum, the weights being dependent on the mass-to-charge ratio.

FURTHER ADVANTAGES OF THE INVENTION

This method has further advantages. For example, daughter ion spectra of the analysis substances may be compared with granddaughter ion spectra of the reference (or vice versa). Different fragmentation conditions may be set for both substances, so that each is optimal for the substance.

In particular however, disturbing superimpositions of signals can be avoided: for example, daughter ion spectra from the analyte substance and reference, which appear the same, may be compared to one another. An example: if a substance that contains a trichloromethyl group ($^{12}C^{37}Cl_3$) group marked with the isotope 37u of chlorine is used as a reference, the molecular ion of this reference can be isolated very easily from the molecular ion of the analyte substance with normal chlorine. If however, during daughter ion formation, this group is lost, the daughter ions of the analyte and reference substances have the same masses. In separately scanned spectra, they still may be measured well separated.

DESCRIPTION OF THE FIGURE

FIG. 1 shows the simple and fast calculation algorithm for the linear, quadratic and cubic extrapolation of the filling rates $f_0$ from the measured filling rates $f_1$ to $f_4$ from the preceding spectra, if these—as usual—have the same scanning time intervals.

DESCRIPTION OF FAVORABLE EMBODIMENTS

A first embodiment for comparative analysis relates to the measurement of the reaction kinetics of ion-molecule reactions. In principle, ions of one type are stored here in an ion trap and caused to react through collisions with the molecules of a reactant gas. Consumption of the original ions and an increase in product ions are measured as a function of the reaction time (the waiting time until scanning of the spectra) and the reactant gas concentration. Reaction time constants and the reaction type are determined from the measurements.

Here the original ions may be generated in an ion source outside the ion trap and introduced in the known manner into the ion trap. The reactant gas may always remain in the ion trap through continuous introduction. To determine the time constants, analysis spectra are scanned each time with increasing waiting time until the scan.

The comparative analysis, in this case, has the purpose to verify the constancy of all method conditions including the constancy of the concentration of the supplied reactant gas. To do this, a reference method is defined using a standard waiting time, and analysis and reference spectra are each scanned according to this invention by interchanging spectra with independent control of the filling.

For measurement of the dependency on the reactant gas concentration, one may similarly define a reference method by which the concentration of the reference gas can be verified, for example, and even controlled if necessary.

If the original ions for the ion-molecule reactions are formed by an electron beam within the ion trap, it may be necessary to isolate the product ions for the reaction at first, in order to switch off secondary reactions of simultaneously formed, though undesirable, ions. Isolation can, for example, be generated in a known way by a frequency mixture with frequency gaps which is applied to both end caps of the ion trap and thus generates a dipolar field with mixed excitation frequencies in the ion trap. The excitation frequencies cause the undesirable ions to oscillate between the end caps, the oscillation amplitudes are magnified and the ions are finally removed from the ion trap. The frequency gap thus determines the desirable ions which remain in the ion trap because their fundamental frequencies are not excited.

Since the control of filling relates to the measured ions from the last spectra of the same type, the control of the optimal filling quantity includes the isolation.

However, it is not necessary to perform the isolation during ion generation and storage. The ion trap may be filled with ions during ion generation until far beyond the optimal filling quantity and only then use the isolation. Since isolation also works just as well if the ion trap is overloaded by more than one hundred times, the temporary overload of the filling time control according to this invention can be intentionally controlled in such a way that, in this case, the optimal filling quantity of the ion trap occurs only after isolation of the desired ion species. The "filling rate" therefore, includes in this case, the process of initial overload and the subsequent isolation. Since the control of the filling quantity according to the invention relates to the integral ion quantities of the preceding spectra of the same generating type, it is not even necessary to know how great the overload actually is in a specific case.

A second embodiment of the method according to this invention relates to the quantitative analysis using one or more internal reference substances. Let us assume, that only one reference substance is added to accurately analyze one analyte substance. Here, a known amount of a reference substance is fed to the analyte sample in which the analyte substance is found. The reference substance should be as similar as possible to the analyte substance. For example, an isotope-marked compound may be chosen as a reference which is chemically identical to the analysis substance. For the subsequent sample preparation steps, such as enrichment of the analyte substance in the sample by extraction, for example, the analysis and reference substances then behave absolutely the same.

In comparative analyses with internal reference performed in magnetic sector field units or also in quadruple filter mass spectrometers, the signals of the analyte ions and the reference ions are measured in the same mass spectrum and then compared to one another, since the dynamic range of measurement in the spectrum is sufficiently large. This is not possible in ion trap mass spectrometers due to the low dynamic range of measurement.

According to the present invention, the analyte ions and the reference ions are therefore measured in separate individual spectrum measurements, whereby the filling rate for the two types of spectrum measurements is controlled separately. These individual spectra can however only be measured separately by isolation of the corresponding ion species, since both ion species are ionized together.

If the possibility exists that the analyte or reference ions are also superimposed by other ions of the same mass (more precise: the same mass-to-charge ratio), both ion species may then also be fragmented into daughter ions, before the spectra are measured. As long as the superimposing ions are not too intensive and generate other daughter ions, both daughter ion types may be measured separately in a pure form and compared correspondingly to one another.

In this manner, the concentration of analyte substances can often be measured without even requiring a mixture separation using chromatographic or electrophoretic separation methods.

Of particular importance are, for example, measurements of the metabolism of pharmacological substances. For the approval of a new medicament, it is necessary to clarify the metabolism of such substances through all degradation stages, to determine the dwell times of all intermediate products in the human body and to measure very accurately the spread of all values in different people. To do this, tens of thousands of analyses are necessary.

For these measurements, analysis methods are sought which may be performed with sufficient reliability in the shortest amount of time.

Since most metabolites are not easily volatilized, but are easily soluble in water and other solvents, liquid chromatography in conjunction with electrospray ionization has particularly become established for these measurements. In order to shorten the analysis time, the liquid chromatography is shortened as far as possible by the selection of conditions. Here, a complete separation of all mixture components no longer takes place. Through the use of daughter ion spectra, sufficient substance-specific analyses are achieved however. The required precision is between 1% and 10% single relative standard deviation, according to the toxicity of the metabolites; internal reference methods are necessary in order to ensure accuracy.

If this method is to be performed in ion traps, an addition of several spectra is generally necessary. The analysis method then takes the following form: in the input station of a short-column liquid chromatograph, the prepared sample, to which an isotope-marked reference of medium concentration is added before preparation, is injected at intervals of about three minutes. Beyond the peak of the metabolite, which is about 10 seconds wide, time-interchanged daughter ion spectra from the metabolite and reference are scanned according to the invention, whereby two control strings each generate the optimal filling quantity. Each of five daughter ion spectra for every substance are added. Since the scanning of an individual daughter ion spectrum takes a total of 200 milliseconds, five such individual spectra may be scanned per second. Since the chromatographic peak has a width of about 10 seconds, a total of five sum spectra of the metabolite and five sum spectra of the reference are scanned. Of these, the middle three sum spectra are excellently suited for evaluation; the individual spectra for the first sum spectrum help allow the control to become steady. Using the scanning technique, the analysis problem can be solved and the required precision may be attained, even if the individual spectrum does not attain the precision by any means.

The control in this case best relies on a cubic extrapolation, since the signal in the chromatographic peak changes very suddenly. The schematic of a cubic extrapolation is shown in FIG. 1. From the four filling rates $f_1$ (most recent daughter ion spectrum) to $f_4$, the differences $a_1$ to $a_3$ are formed, from this the differences $b_1$ and $b_2$, and from this the difference $c_1$. The cubic extrapolation for the expected value $f_{cub}$ derives very easily from $f_{cub}=f_1+a_1+b_1+c_1$. This very simple calculation presumes that the temporal intervals for the scans are equal.—The linear extrapolation works out as $f_{lin}=f_1+a_1$; the quadratic extrapolation reads $f_{qu}=f_1+a_1+b_1$.

There are hundreds of different types of comparative analysis methods for very different purposes. For a specialist in the field, it is easy to develop methods tailored specifically to his needs for different types of comparative analyses according to the descriptions and guidelines given here.

We claim:

1. Method for the measurement of ion signals from different origins or different generation conditions, for the purpose of a comparative analysis, in space charge controlled ion trap mass spectrometers, comprising the steps of 1) preparing a data evaluation method to calculate, for each spectrum measured, an ion trap filling rate, defined as amount of ions, obtained by integration over the ion current of a spectrum, divided by the known filling time, 2) preparing different types of spectrum measurement procedures by which the different ion signals to be compared with each other can be measured, in different spectra, undisturbed by other ion signals present in the spectrum, whereby the control of space charge for the measurement relies on a forecast filling rate derived from the filling rates measured in previous measurements of the same type of spectrum measurement procedure, and 3) performing the different types of measurement procedures alternately or cyclically.

2. Method according to claim 1, wherein the forecast value is assumed to be equal to that of the filling rate of the last preceding individual spectra of the same type.

3. Method according to claim 1, wherein the forecast value for the filling rate is calculated from the filling rates of several previously measured spectra of the same type by mathematical extrapolation.

4. Method according to claim 3, wherein a linear, quadratic or cubic extrapolation of the filling rates from two, three or four spectra is made.

5. Method according to claim 3, wherein an exponential extrapolation of the filling rate is made from two spectra.

6. Method according to claim 1, wherein the comparative analysis is a quantitative analysis of an analyte substance in a sample with a known amount of reference substance added to the sample, wherein, in two different spectrum measurement procedures, the isolated ions of the analyte substance and the isolated ions of the reference substance are measured each, and wherein the filling rates include any ion losses by the ionization, storage and isolation processes.

7. Method according to claim 1, wherein the comparative analysis is a quantitative analysis of an analyte substance in a sample with a known amount of reference substance added to the sample, wherein, in two different spectrum measurement procedures, daughter ions of a parent ion from the analyte substance and daughter ions of a parent from the reference substance are measured each, and wherein the filling rates include any ion losses by the ionization, storage, isolation and fragmentation processes.

8. Method according to claim 1, wherein a chromatographic or electrophoretic separation is placed ahead of the mass spectrometric analysis.

9. Method according to claim 1, wherein several individual spectra of each ion species are added together to produce a sum spectrum, and the sum spectra are quantitatively evaluated.

10. Method according to claim 1, wherein the integration of step 1 over the ion current is a weighted integration, whereby the weight depends on the mass-to-charge ratio of the ions.

* * * * *